US012157655B2

(12) United States Patent
Jenkins

(10) Patent No.: US 12,157,655 B2
(45) Date of Patent: Dec. 3, 2024

(54) SPOOL ASSEMBLY

(71) Applicant: Scientific Anglers LLC, Midland, MI (US)

(72) Inventor: Joshua Herbert Jenkins, Midland, MI (US)

(73) Assignee: Scientific Anglers LLC, Midland, MI (US)

( * ) Notice: Subject to any disclaimer, the term of this patent is extended or adjusted under 35 U.S.C. 154(b) by 342 days.

(21) Appl. No.: 17/749,345

(22) Filed: May 20, 2022

(65) Prior Publication Data

US 2022/0380170 A1 Dec. 1, 2022

Related U.S. Application Data

(60) Provisional application No. 63/193,702, filed on May 27, 2021.

(51) Int. Cl.

| | |
|---|---|
| ***B65H 75/22*** | (2006.01) |
| ***B65H 54/58*** | (2006.01) |
| ***B65H 54/60*** | (2006.01) |
| ***B65H 75/14*** | (2006.01) |
| ***B65H 75/24*** | (2006.01) |

(52) U.S. Cl.

CPC ..... *B65H 75/2245* (2021.05); *B65H 54/58* (2013.01); *B65H 54/60* (2013.01); *B65H 75/14* (2013.01); *B65H 75/2272* (2021.05); *B65H 75/24* (2013.01); *B65H 75/246* (2013.01); *B65H 2701/355* (2013.01); *B65H 2701/50* (2013.01)

(58) Field of Classification Search

CPC .. B65H 75/2272; B65H 54/60; B65H 75/246; B65H 75/22; B65H 75/364

See application file for complete search history.

(56) References Cited

U.S. PATENT DOCUMENTS 329,053 A 10/1885 William
1,820,693 A * 8/1931 Dreisbach ..... B65H 75/24 242/575.5

(Continued)

FOREIGN PATENT DOCUMENTS

CA 2164386 A1 * 6/1997 ..... B65H 75/2272
DE 4301317 A1 * 7/1994 ..... B65H 75/242
DE 102008060323 B4 * 3/2014 ..... B21C 47/30

OTHER PUBLICATIONS

DE-4301317-A1 merged with translation (Year: 1994).*
European Patent Application No. 22174473.3; Extended Search Report; dated Oct. 18, 2022; 7 pages.

*Primary Examiner* — Sang K Kim
(74) *Attorney, Agent, or Firm* — BakerHostetler

(57) ABSTRACT

A spool assembly configured to support a roll of material. The spool assembly comprises a first and second flange coupled together via a first and second arbor member. The first arbor member is slidably coupled within a first at least one slot of the first flange and slidably coupled within a second at least one slot of the second flange. A biasing member is coupled to the first arbor member such that the first arbor member is biased radially inward toward a longitudinal axis of the spool assembly. Rotation of the first flange relative to the second flange causes the first arbor member to translate within the first at least one slot and the second at least one slot causing a change in the arbor diameter.

21 Claims, 10 Drawing Sheets

(56) References Cited

U.S. PATENT DOCUMENTS

| | | | | | |
|---|---|---|---|---|---|
| 1,950,492 | A * | 3/1934 | Holmer, Jr. | B65H 49/305 | 242/575.5 |
| 2,229,796 | A | 1/1941 | Oscar | | |
| 2,335,179 | A * | 11/1943 | Feller | G03B 21/321 | 242/356.5 |
| 2,858,998 | A * | 11/1958 | Nadolskey | A01K 89/033 | 242/317 |
| 3,026,060 | A * | 3/1962 | Norehad | B65H 75/08 | 242/527.6 |
| 4,369,818 | A * | 1/1983 | Yoshida | D03D 47/361 | 139/452 |
| 4,456,020 | A * | 6/1984 | van Deursen | A45D 2/24 | 132/265 |
| 4,728,054 | A * | 3/1988 | Pisapio | A01K 89/016 | 242/270 |
| 4,850,544 | A * | 7/1989 | Snijders | D03D 47/362 | 242/364 |
| 6,533,205 | B1 | 3/2003 | Kles | | |
| 6,554,217 | B1 * | 4/2003 | Rodriguez | G02B 6/4457 | 242/573.7 |
| 9,908,738 | B1 * | 3/2018 | Tóth | B65H 49/305 | |
| 2009/0090806 | A1 * | 4/2009 | Chen | B65H 75/2227 | 242/401 |
| 2014/0283664 | A1 * | 9/2014 | Blette | B65H 75/32 | 242/600 |

* cited by examiner

SPOOL ASSEMBLY

CROSS-REFERENCE TO RELATED APPLICATIONS

This application claims benefit to U.S. Provisional Application No. 63/193,702 filed May 27, 2021, the disclosure of which is herein incorporated by reference in its entirety.

TECHNICAL FIELD

This disclosure relates generally to a spool assembly, more particularly, a spool assembly with an adjustable arbor size.

BACKGROUND

Filament products can be removed from a reel and stored for later use to protect and maintain the performance of the product. The filament product can include new filaments and/or existing filaments that are going to be left on a reel for any length of time, and subsequently removed and stored. The filament product is typically removed by winding the product directly onto a spool or other similar device to form a coil, or the filament can be wound into a coil without the use of a spool or other device. The coil is tied then stored for later use.

Typically, fly fishing lines are stored and packaged in a loose coil. In some instances, the fishing lines are wound about a storage spool, and the coil remains on the storage spool until later use. To reuse the fishing line, the filament is unwound from the coil or storage spool and re-wound about the reel. When winding the coil about the reel, the coil can be loose and become tangled and/or slippage can occur between the filament and reel.

The foregoing background discussion is intended solely to aid the reader. It is not intended to limit the innovations described herein. Thus, the foregoing discussion should not be taken to indicate that any particular element of a prior system is unsuitable for use with the innovations described herein, nor is it intended to indicate that any element is essential in implementing the innovations described herein.

SUMMARY

The foregoing needs are met, to a great extent, by the spool assembly disclosed in the present application. The spool assembly includes two flanges, and sliding members that comprise the arbor of the spool. The spool assembly allows a user to create a coil of filament and to remove said coil from the spool for storage. Additionally, the spool assembly can be used to apply tension on the inside of coiled filament for dispensing without slippage or tangling. The sliding members penetrate each flange by extending radially outward, filament cannot slip between the sliding members and flanges.

As will be further explained herein, a first flange orients and allows motion of the sliding members in a radial direction. A second flange adjusts the radial distance of the sliding members from the center of rotation by rotating the second flange relative to the first flange. The second flange can include mating cam profiles and can be removable from the sliding members. A diameter of the arbor (defined by the sliding members), is adjusted by rotating the flanges relative to each other. The second flange can be removed once the sliders have reached their radially innermost position. Detents can be provided on the cam profile of the second flange to create distinct holding points for the sliding members. A biasing force can be applied to the sliding members such that they default to a collapsed position at the minimum (radially innermost position) of their travel. The biasing force forces the sliding members against the cam profile and detents.

An aspect of the present disclosure provides a spool assembly for supporting a roll of material. The spool assembly comprises a first flange, a second flange, a first arbor member, a second arbor member, and a biasing member. The first flange defines a first at least one slot, the first at least one slot extending at least partially in a radial direction. The radial direction extends outward from a longitudinal axis of the spool assembly. The second flange defines a second at least one slot that extends at least partially in a transverse direction. The transverse direction being substantially perpendicular to the radial direction and the longitudinal axis. The second flange being rotatably coupled to the first flange such that the first and second flanges rotate relative to one another about the longitudinal axis.

The first arbor member is slidably coupled within the first at least one slot of the first flange and slidably coupled within the second at least one slot of the second flange. The first arbor member is positioned at least partially between the first flange and the second flange. The second arbor member is positioned between the first flange and the second flange, wherein a spacing between the first arbor member and the second arbor member in the radial direction defines an arbor diameter. The biasing member is coupled to the first arbor member such that the first arbor member is biased radially inward toward the longitudinal axis. Rotation of the first flange relative to the second flange causes the first arbor member to translate within the first at least one slot and the second at least one slot causing a change in the arbor diameter Another aspect of the present disclosure provides a method of assembling a spool assembly. The spool assembly including a first flange, a second flange, and a first arbor member. The first flange defining a first at least one slot, the first at least one slot extending at least partially in a radial direction. The radial direction extending radially outward from a longitudinal axis of the spool assembly. The first arbor member slidably coupled within the first at least one slot. The method comprises: inserting the first arbor member into the first at least one slot defined by the first flange; and coupling a biasing member to the first arbor member such that the first arbor member is biased radially inward toward the longitudinal axis. Whereby rotation of the first flange relative to the second flange causes the first arbor member to translate within the first at least one slot causing a change in an arbor diameter.

This summary is provided to introduce a selection of concepts in a simplified form that are further described below in the Detailed Description section. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there are shown in the drawings illustrative embodiments of the disclosure. It should be understood, however, that the application is not limited to the precise arrangements and instrumentalities shown. In the drawings.

DETAILED DESCRIPTION

Figure 1:
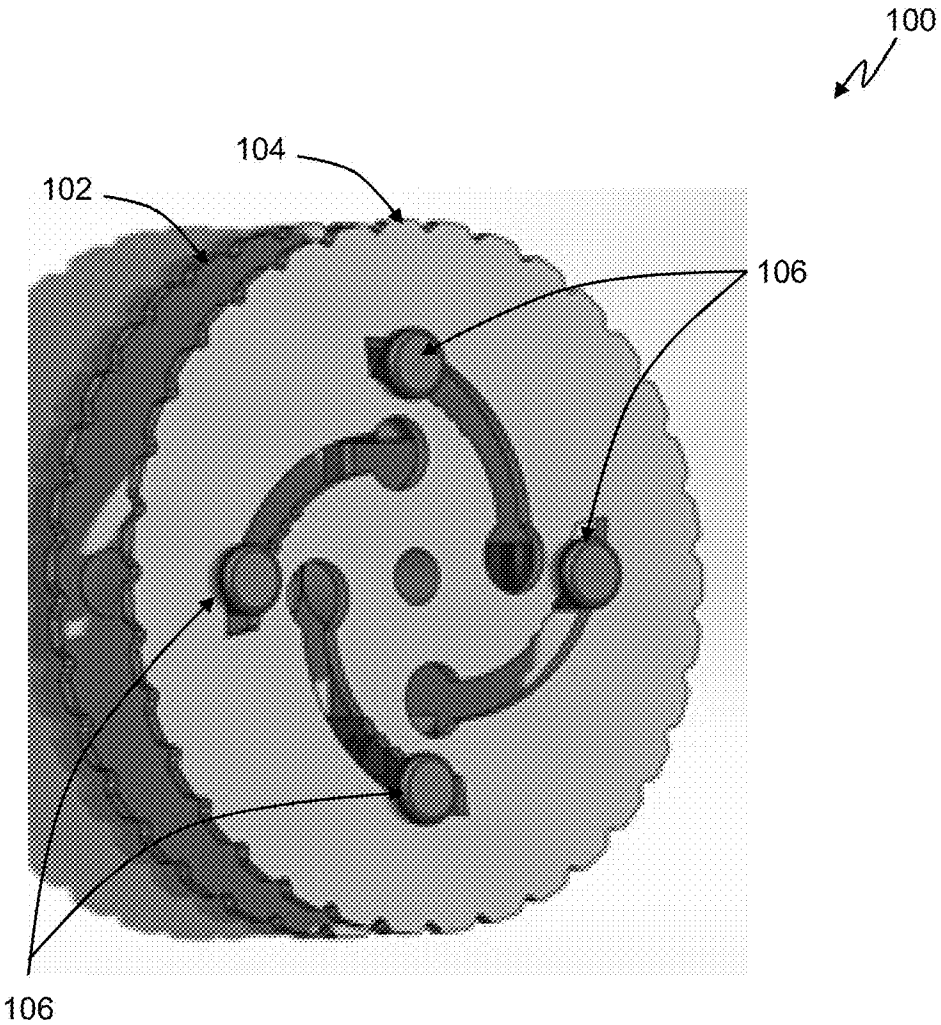
FIG. 1 illustrates a top perspective view of a spool, according to an aspect of this disclosure.
Figure 3:
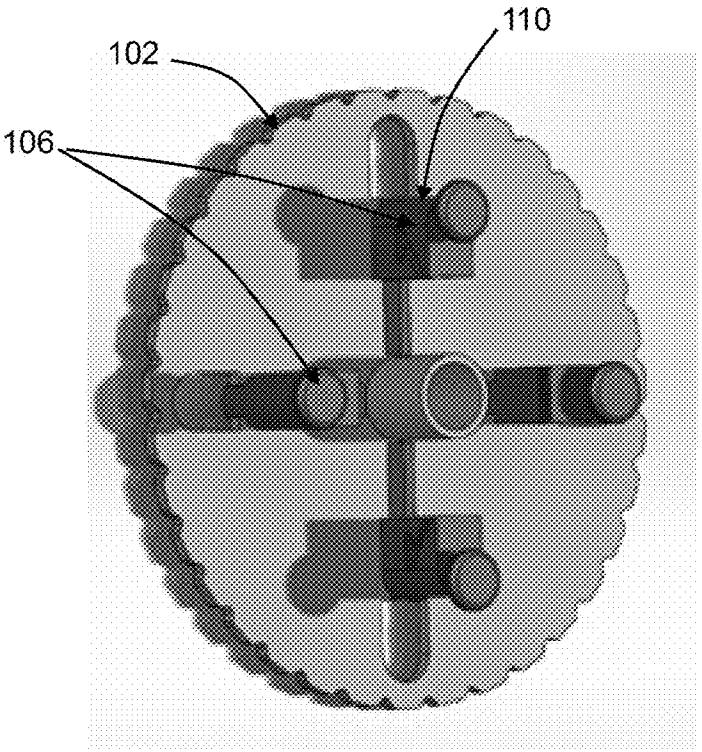
FIG. 3 illustrates a top perspective view of a second configuration of the spool shown in FIG. 1 with a flange removed.
Figure 2:
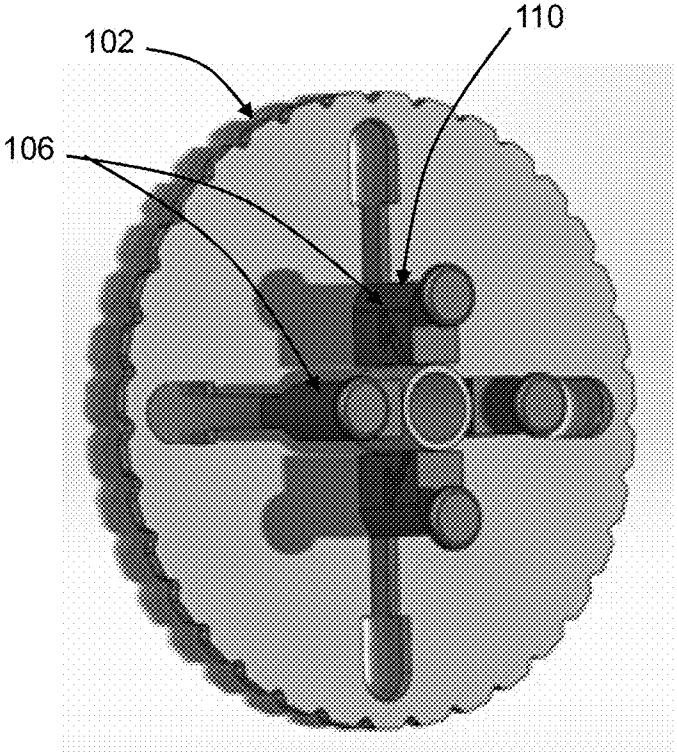
FIG. 2 illustrates a top perspective view of a first configuration of the spool shown in FIG. 1 with a flange removed.
Figure 4:
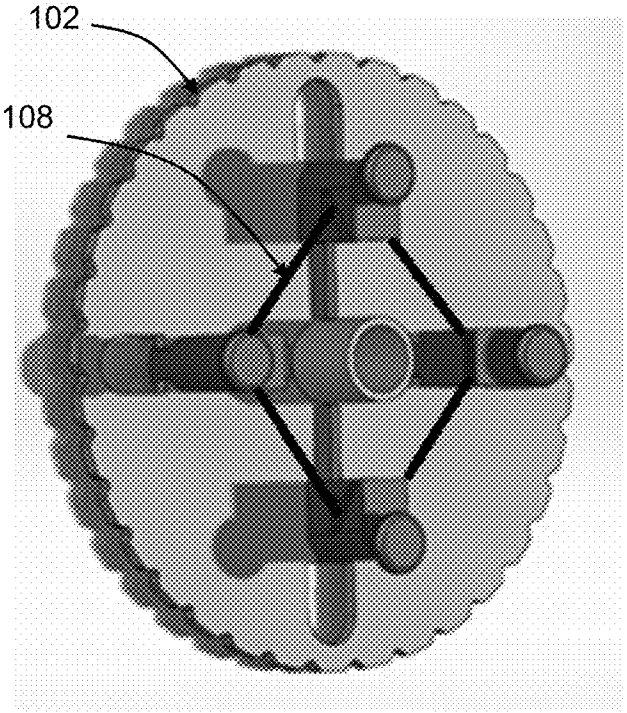
FIG. 4 illustrates a top perspective view of the second configuration of the spool shown in FIG. 3 with a biasing member.
Figure 5:
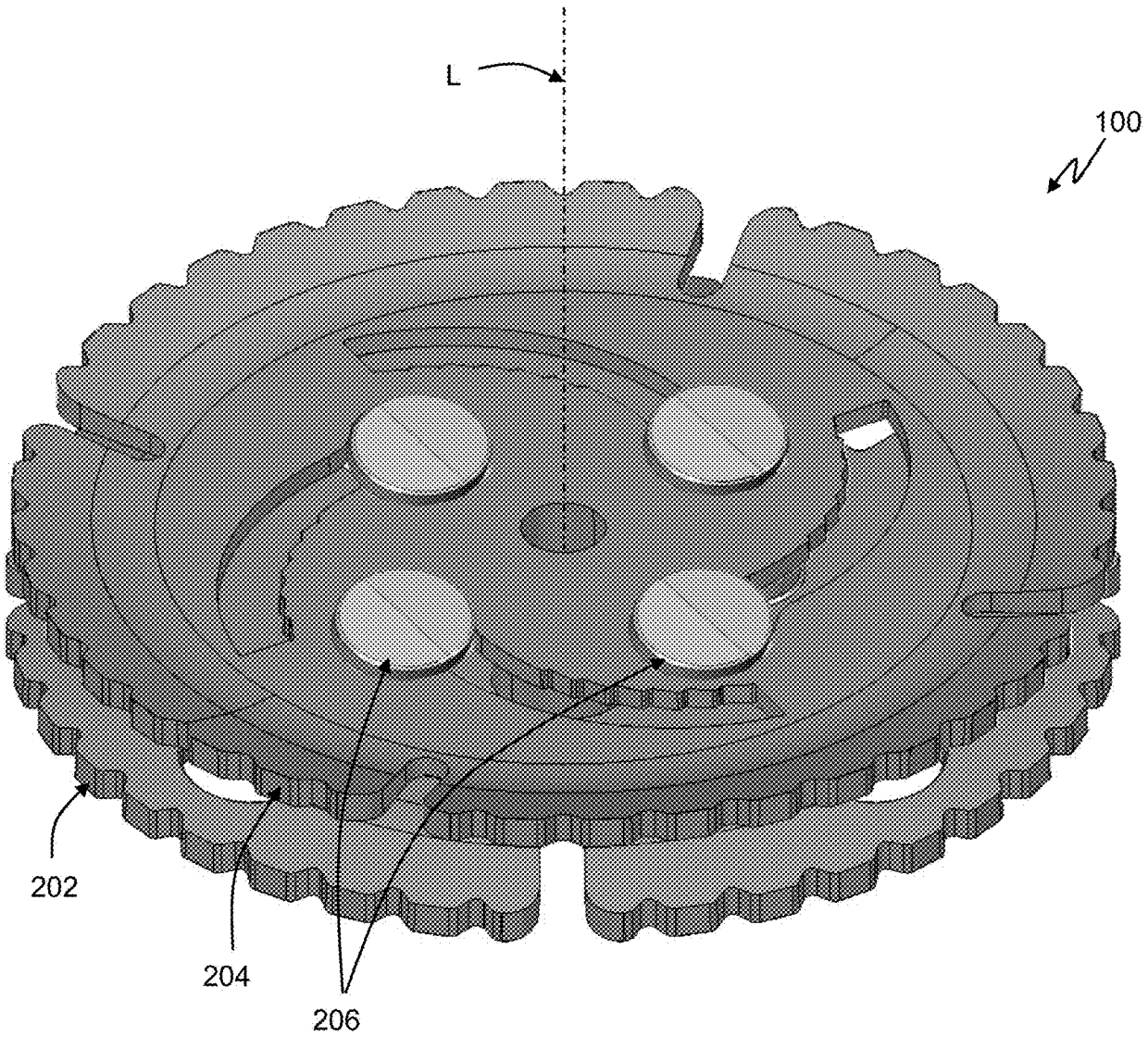
FIG. 5 illustrates a top perspective view of another configuration of a spool, according to an aspect of this disclosure.
Figure 7:
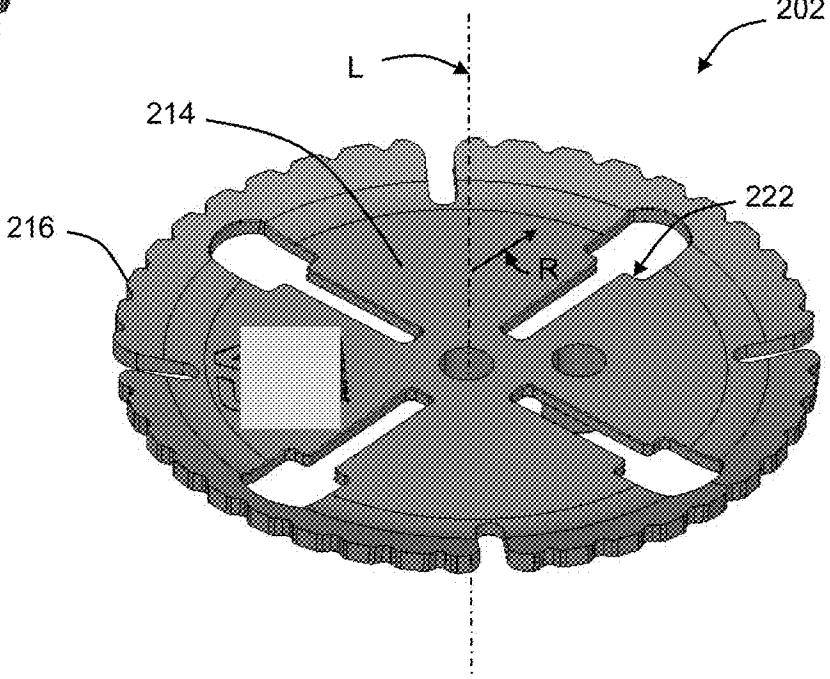
FIG. 7 illustrates a bottom perspective view of the flange illustrated in FIG. 6.
Figure 6:
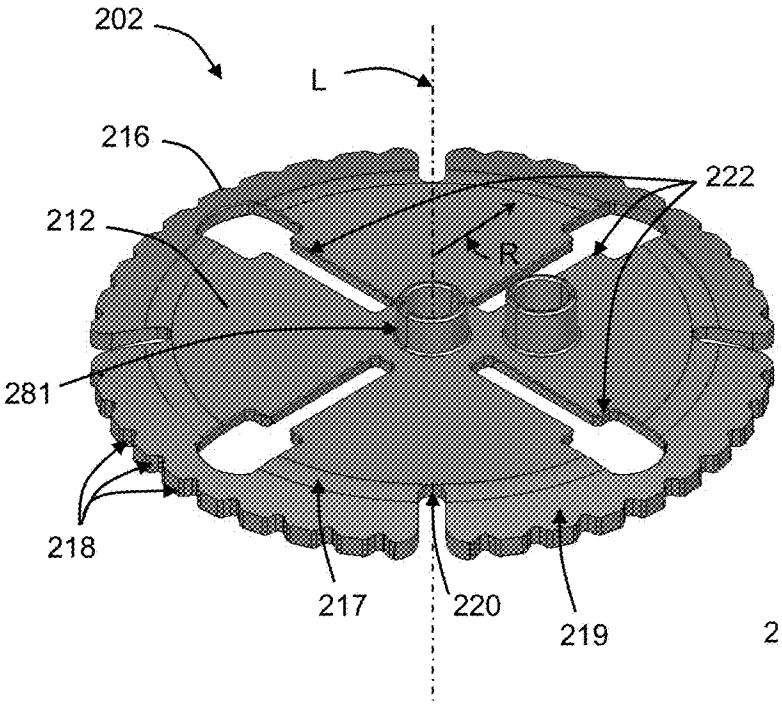
FIG. 6 illustrates a top perspective view of flange of the spool shown in FIG. 5, according to an aspect of this disclosure.

Certain terminology used in this description is for convenience only and is not limiting. The words "axial", "radial", "circumferential", "outward", "inward", "upper," and "lower" designate directions in the drawings to which reference is made. As used herein, the term "substantially" and derivatives thereof, and words of similar import, when used to describe a size, shape, orientation, distance, spatial relationship, or other parameter includes the stated size, shape, orientation, distance, spatial relationship, or other parameter, and can also include a range up to 10% more and up to 10% less than the stated parameter, including all the intermediate values, for example, 5% more and 5% less, including 3% more and 3% less, including 1% more and 1% less. All ranges disclosed herein are inclusive of the recited endpoint and independently combinable (for example, the range of "from 2 grams to 10 grams" is inclusive of the endpoints, 2 grams and 10 grams, and all the intermediate values). The terminology includes the above-listed words, derivatives thereof and words of similar import.

FIGS. 1 through 4 illustrate a spool assembly 100, according to an aspect of this disclosure. The spool assembly 100 includes a first flange 102, a second flange 104, arbor members 106, and a biasing member 108. The arbor members 106 define an arbor 110 of the spool assembly 100 configured to support a roll or coil of material thereon. The first and second flanges 102 and 104 of the spool assembly 100 can comprise a plastic material, which can be at least semi-rigid to maintain its shape during coiling of a roll of material.

The first and second flanges 102 and 104 are configured to rotatably couple to one another via the arbor members 106, as further described below. A rotation between the first and second flanges 102 and 104 can cause the arbor members 106 to increase and decrease a diameter size of the arbor 110. For example, rotation of the second flange 104 relative to the first flange 102 in a first rotational direction can increase the diameter of the arbor 110, and rotation of the second flange 104 relative to the first flange in an opposing rotational direction can decrease the diameter of the arbor 110. When the diameter of the arbor 110 is decreased (see e.g. FIG. 2), the roll of material retained on the arbor 110 can be removed. When the diameter of the arbor 110 is increased (see e.g. FIG. 3), a tension can be applied to the roll of material positioned on the arbor 110. The biasing member 108 can be configured to bias the arbor members 106 toward a rotational center of the spool assembly 100. (e.g. toward a minimum diameter configuration). The biasing member 108 can include a single member coupled to each of the arbor member 106. Alternatively, spool assembly 100 can include multiple biasing members 108 that are each coupled to a respective arbor member 106.

FIGS. 5 through 19 illustrate a spool assembly 200, according to an aspect of this disclosure. It will be appreciated that the spool assembly 100 can be transitioned, aligned, and configured in a substantially similar manner as the spool assembly 200 described herein. It will be appreciated that spool assembly 200 can include configurations and/or components of the spool assembly 100, and vice versa. The spool assembly 200 includes a first flange 202, a second flange 204, arbor members 206, and a biasing member (now shown). Each of the first and second flanges 202 and 204, the arbor members 206, and the biasing member can be individually formed components that, when assembled together, define the arbor assembly 200. Rotation of the first flange 202 relative to the second flange 204 about a longitudinal axis L of the spool assembly 200 causes the arbor members 206 to move and adjust an arbor diameter of the spool assembly 200, as further described herein. In an aspect, the longitudinal axis L extends through a radial center of the spool assembly 200.

FIGS. 6 through 9 illustrate views of the first flange 202. The first flange 202 includes a first inner surface 212, an opposing first outer surface 214, and a perimeter 216. The perimeter 216 is defined by a radially outermost portion extending about the first flange 202, between the first inner and outer surfaces 212 and 214. The perimeter 216 can be defined by a radially outermost edge of the first inner surface 212 and/or a radially outermost edge of the second inner surface 214. In an aspect, the perimeter 216 extends circumferentially about the longitudinal axis L. The perimeter 216 can include a plurality of ridges 218 spaced about the perimeter 216. The ridges 218 can facilitate rotation of the first flange 202 relative to the second flange 204 by providing a grip for a user. The perimeter 216 can also include one or more notches 220 spaced about the perimeter 216. The notches 220 can hold a tie, wire, string, or other coil retaining/tying component to facilitate tying the roll of material after de-coiling the material from a reel onto the spool assembly 200.

The first inner surface 212 can include a substantially planar surface. For example, the first inner surface 212 located toward the longitudinal axis L of the spool assembly 200 and the perimeter 216 of the first flange 202 can lie on the same plane. Alternatively, the first inner surface 212 can be curved. For example, the first inner surface 212 located toward the longitudinal axis L can extend radially outward on the same plane up until a planar perimeter location 217. From the planar perimeter location 217, which can extend approximately circumferentially about the longitudinal axis L, the first inner surface 212 can curve outward (e.g. bevel) at least partially in a longitudinal direction. The outward curve can define a perimeter portion 219 of the first flange 202, which can facilitate winding the roll of material onto and off of the arbor members 216.

The first flange 202 defines a first at least one slot 222. The first slot 222 extends at least partially in a radial direction R. The radial direction R extends outward from and is substantially perpendicular to the longitudinal axis L of the spool assembly 200. The slot first 222 can include one slot, two slots, three slots, four slots, or more than four slots. In an aspect, when more than one slot 222 is defined by the first flange 202, each of the first slots 222 are spaced equidistantly from each other slot circumferentially about the longitudinal axis L. Additionally, or alternatively, each first slot 222 can be spaced radially outward from the longitudinal axis a substantially similar distance as each of the other first slots 222. Additionally, or alternatively, each of the first slots 222 can be configured substantially similarly as each of the other first slots 222.

Figure 9:
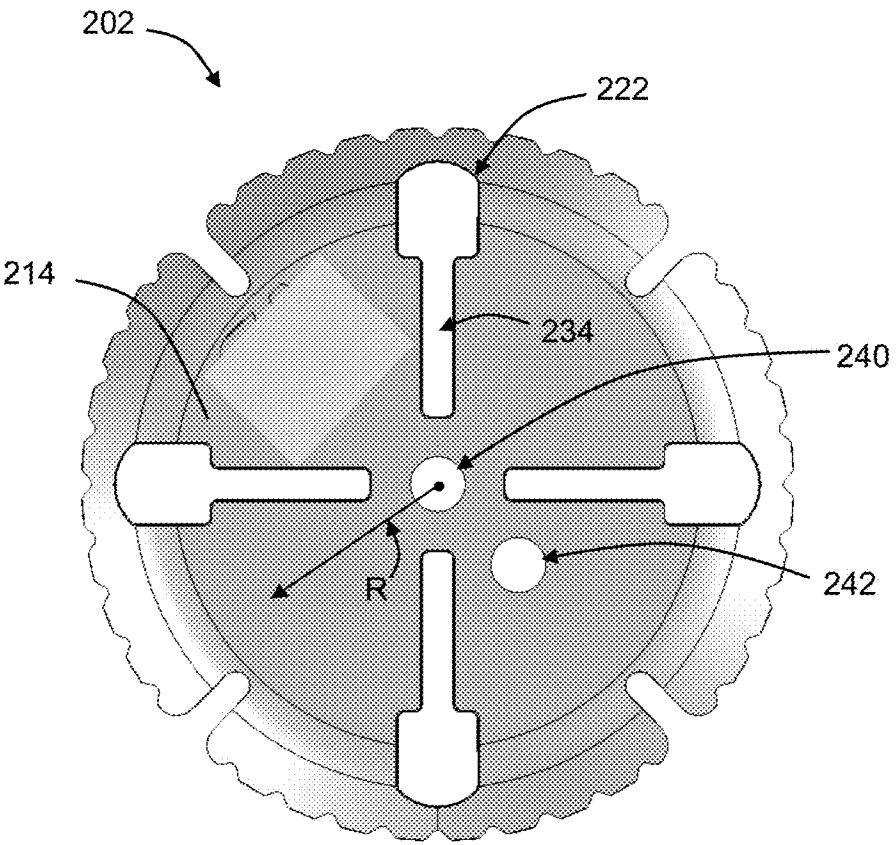
FIG. 9 illustrates a bottom view of the flange illustrated in FIG. 6.
Figure 8:
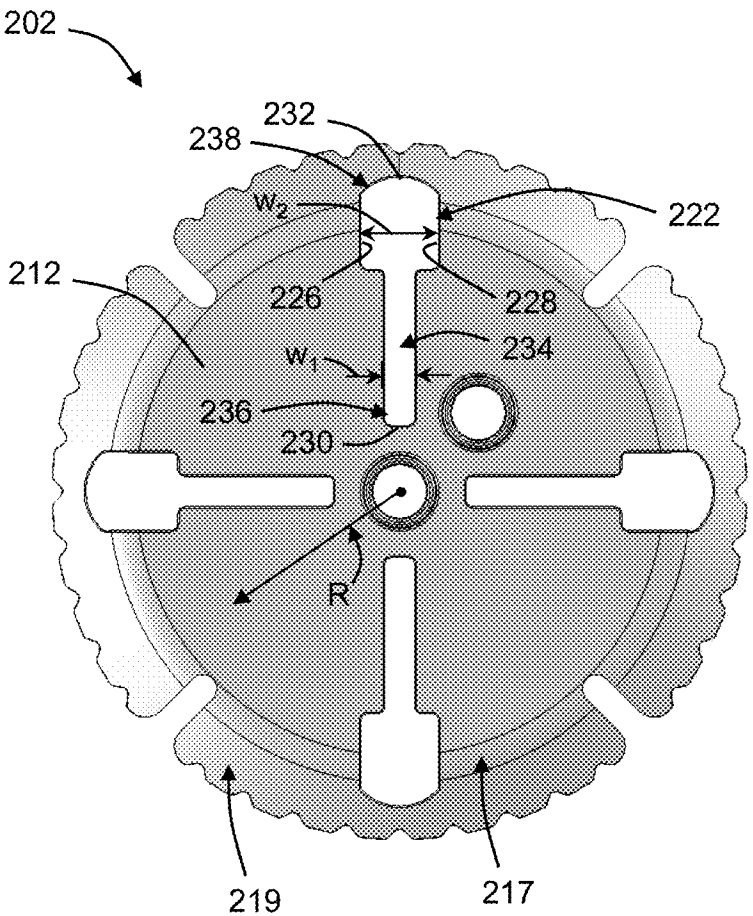
FIG. 8 illustrates a top view of the flange illustrated in FIG. 6.
Figure 11:
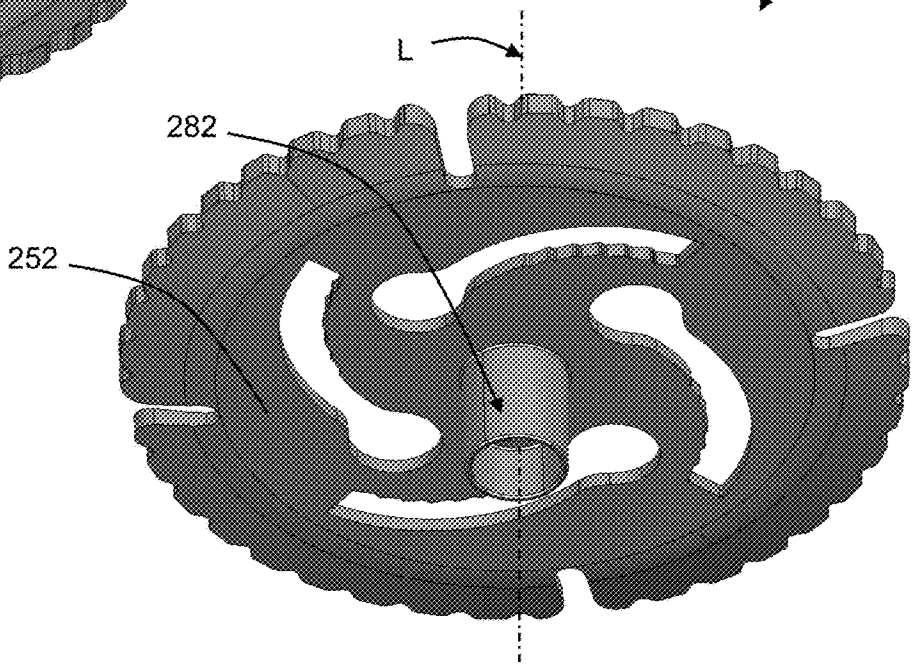
FIG. 11 illustrates a bottom perspective view of the flange illustrated in FIG. 10.
Figure 10:
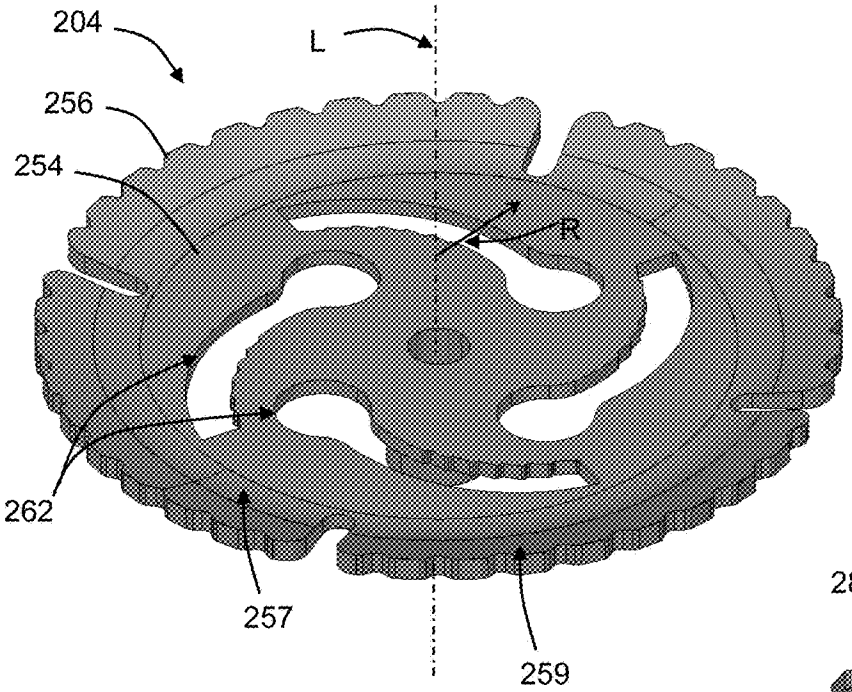
FIG. 10 illustrates a top perspective view of another flange of the spool shown in FIG. 5, according to an aspect of this disclosure.

With reference to FIGS. 8 and 9, the first slot 222 includes a first edge 226 and a second edge 228. The first and second edges 226 and 228 meet at a first location 230 and a second location 232. Between the first and second locations 230 and 232, the first and second edges 226 and 228 are spaced apart from one another to define a first opening 234 therebetween. The first opening 234 extends from a first end 236 of the first slot 222 to a second end 238 of the first slot 222. The second end 238 is spaced radially outward from the first end 236 in the radial direction R. In an aspect, the first slot 222 can be substantially symmetric when viewed in the radial direction R from the longitudinal axis L. In an aspect, the first slot 222 extends substantially linearly in the radial direction R from the first end 236 to the second end 238.

The first end 236 of the first slot 222 defines a first width $w_1$ that extends from the first edge 226 to the second edge 228. The second end 238 of the first slot 222 defines a second width $w_2$ that extends from the first edge 226 to the second edge 228. The second width $w_2$ is greater than the first width $w_1$. The second width $w_2$ is sized to facilitate the insertion and coupling of an arbor member 206 to the first flange 202. For example, the arbor member 206 can be inserted through the first opening 234 at the second end 238 of the slot 222. As further described herein, the arbor member 206 can translate within the first slot 222 between the first end 236 and the second end 238.

The first flange 202 further defines a first receiving aperture 240 and a second receiving aperture 242. The first and second receiving apertures 240 and 242 extend through the first flange 202 from the first inner surface 212 to the first outer surface 214. The second receiving aperture 242 is spaced radially outward from the longitudinal axis L. In an aspect, the first receiving aperture 240 is located at a radial center of the first flange 202. The first receiving aperture 240 can extend about the longitudinal axis L. In an aspect, the first and second receiving apertures 240 and 242 can be sized and/or shaped substantially similarly. The first and second receiving apertures 240 and 242 are configured to receive a handle 400, as further described below.

FIGS. 10 through 13 illustrate views of the second flange 204. The second flange 204 includes a second inner surface 252, an opposing second outer surface 254, and a perimeter 256. The perimeter 256 can be configured according to at least one of the configurations described above in regard to the perimeter 216 of the first flange 202.

The second inner surface 252 can include a substantially planar surface. For example, the second inner surface 252 located toward the longitudinal axis L of the spool assembly 200 and the perimeter 256 of the second flange 204 can lie on the same plane. Alternatively, the second inner surface 252 can be curved. For example, the second inner surface 252 located toward the longitudinal axis L can extend radially outward on the same plane up until a planar perimeter location 257. From the planar perimeter location 257, which can extend approximately circumferentially about the longitudinal axis L, the second inner surface 252 can curve outward (e.g. bevel) at least partially in the longitudinal direction. The outward curve can define a perimeter portion 259 of the second flange 204, which, when coupled to the first flange 202, can facilitate winding the roll of material onto and off of the arbor members 216.

The second flange 204 defines a second at least one slot 262. The second slot 262 extends at least partially in a transverse direction T. The transverse direction T is substantially perpendicular to the radial direction R and the longitudinal axis L of the spool assembly 200. The second slot 262 can include one slot, two slots, three slots, four slots, or more than four slots. In an aspect, when more than one second slot 262 is defined by the second flange 204, each of the slots 262 are spaced equidistantly from each other slot circumferentially about the longitudinal axis L. Additionally, or alternatively, each slot 262 can be spaced radially outward from the longitudinal axis a substantially similar distance as each of the other slots 262. Additionally, or alternatively, each of the slots 262 can be configured substantially similarly as each of the other slots 262. In an aspect, the number of first slots 222 defined by the first flange 202 includes the same number of second slots 262 defined by the second flange 204. Each of the first and second slots 222 and 262 align in the longitudinal direction during rotation of the first and second flanges 202 and 204 relative to one another.

Figure 13:
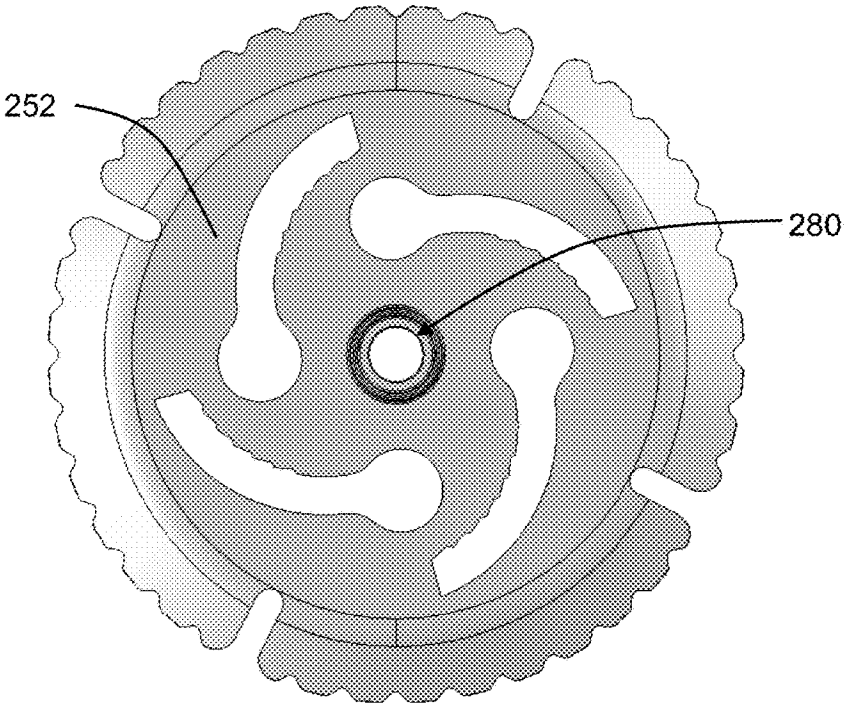
FIG. 13 illustrates a bottom view of the flange illustrated in FIG. 10.
Figure 12:
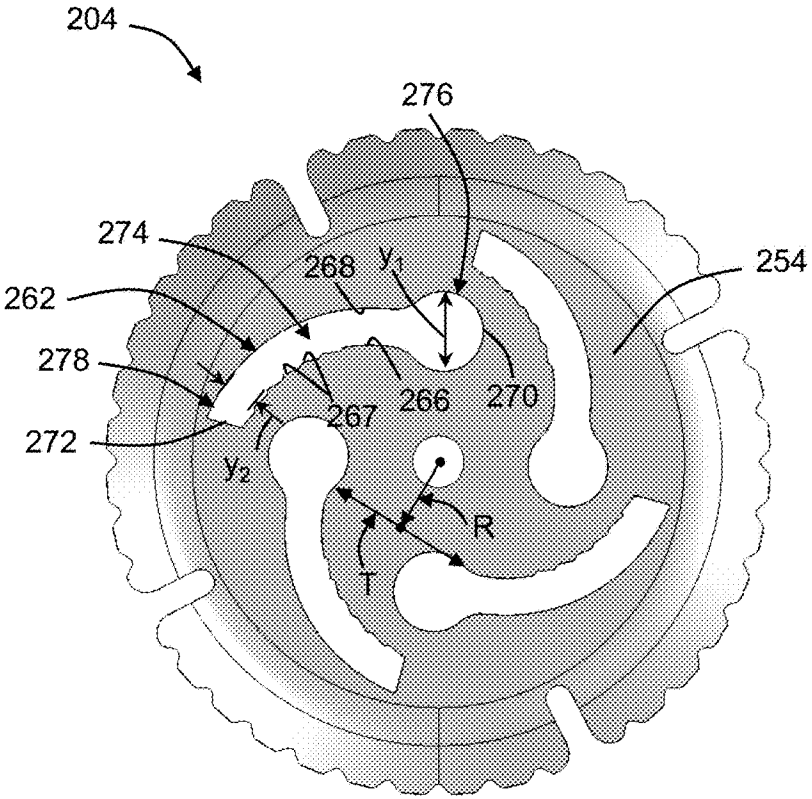
FIG. 12 illustrates a top view of the flange illustrated in FIG. 10.

With reference to FIGS. 12 and 13, the second slot 262 includes a first edge 266 and a second edge 268. The first and second edges 266 and 268 meet at a first location 270 and a second location 272. Between the first and second locations 270 and 272, the first and second edges 266 and 268 are spaced apart from one another to define a second opening 274 therebetween. The second opening 274 extends from a first end 276 of the slot 262 to a second end 278 of the slot 222. The second end 278 is spaced radially outward from the first end 276 in the radial direction R. In an aspect, the slot 262 extends in a substantially arcuate shape from the first end 276 to the second end 278. In an aspect, the slot 262 extends substantially circumferentially about an axis that is parallel to and offset from the longitudinal axis L.

The first end 276 of the second slot 262 defines a first width $y_1$ that extends from the first edge 266 to the second edge 268. The second end 278 of the second slot 262 defines a second width $y_2$ that extends from the first edge 266 to the second edge 268. The second width $y_2$ is less than the first width $y_1$. The first width $y_1$ is sized to facilitate the insertion and coupling of the arbor member 206 to the second flange 204. For example, the arbor member 206 can be inserted through the second opening 274 at the first end 276 of the second slot 262. As further described herein, the arbor member 206 can translate within the slot 262 between the first end 276 and the second end 278.

The second flange 204 further defines a third receiving aperture 280. The third receiving aperture 280 extends through the second flange 204 from the second inner surface 252 to the second outer surface 254. In an aspect, the third receiving aperture 280 is located at a radial center of the second flange 204. The third receiving aperture 280 can extend about the longitudinal axis L. In an aspect, the third receiving aperture 280 can be sized and/or shaped substantially similarly to the first and second receiving apertures 240 and 242 of the first flange 202. The third receiving aperture 280 is configured to receive the handle 400, as further described below. It will be appreciated that the second flange 204 can include more than one receiving aperture.

The first edge 266 of the second slot 262 is spaced radially inward from the second edge 268 of the second slot 262 along a length of the second slot 262 from the first end 270 to the second end 272. The first edge 266 defines a plurality of detents 267 positioned between the first and second ends 270 and 272 of the second slot 262. Each of the plurality of detents 267 are configured to releasably prevent the arbor members 206 from sliding within the second opening 174, as further described. The plurality of detents 267 can include, for example, a series of peaks and valleys long the first edge 266. In an alternative aspect, the detents 267 can be located at different locations on either the first flange 202 or the section flange 204. For example, the detents 267 can be included on surfaces and/or edges on a connection between the first flange 202 and the second flange 204. A first axis alignment member 281 (see FIG. 6) of the first flange 202 can couple to a corresponding second axis alignment member 282 (see FIG. 11) of the second flange 204, as further described below. The first and second axis alignment members 281 and 282 can include one or more corresponding detents 267 therebetween that are configured to releasably prevent rotation between the first and second flanges 202 and 204.

The second flange 204 further includes the second axis alignment member 282. The second axis alignment member 282 extends from second inner surface 252 about the longitudinal axis L. The second axis alignment member 282 can be configured to align with and/or couple to the corresponding first axis alignment member 281 (see FIG. 6). The alignment and/or coupling between the first and second axis alignment members 281 and 282 can facilitate rotation of the first flange 202 relative to the second flange 204 about the longitudinal axis. In an aspect, each of the first and second axis alignment members 281 and 282 are formed on the respective first and second flanges 202 and 204 to form two separate unitary integrated flanges 202 and 204. In an alternative, or additional, aspect, the first and second axis alignment members 281 and 282 can be coupled to the respective first and second flanges 202 and 204 to form two separate assembled flanges 202 and 204. It will be appreciated that fewer or more members can be integrated into the spool assembly 200 to rotationally couple the first flange 202 to the second flange 204.

FIGS. 14-17 illustrate different views of the arbor member 206, according to an aspect of this disclosure. The arbor member 206 includes a first end 302 and an opposing second end 304. The first end 302 includes a first retention element 306, and the second end 304 includes a second retention element 316. It will be appreciated that the first retention element 306 can define the first end 302 and/or the second retention element 316 can define the second end 304.

The first retention element 306 has an outer surface 308 that defines a pair of slots 310. The slots 310 of the first retention element 306 have a first cross-sectional dimension $C_1$ and a second cross-sectional dimension $C_2$. The second cross-sectional dimension $C_2$ is less than the first cross-sectional dimension $C_1$. The location of the second cross-sectional dimension $C_2$ is spaced from the location of the first cross-sectional dimension $C_1$ in a direction toward the second end 304 of the arbor member 206. The first cross-sectional dimension $C_1$ is greater than the first width $w_1$ of the first end 236 of the first slot 222. The first cross-sectional dimension $C_1$ is less than the second width $w_2$ at the second end 238 of the first slot 222 of the first flange 202. The second cross-sectional dimension $C_2$ of the first retention member 306 is less than the first width $w_1$ of the first end 236 of the first slot 222 of the first flange 202. The configuration of the arbor member 206 is such that the first end 302 can be inserted into the second end 238 of the first slot 222 of the first flange 202 in a longitudinal direction (e.g. insertion direction). The slots 310 of the first retention member 306 can be positioned within the first opening 234 of the first slot 222 of the first flange 202. When the slots 310 are positioned within the first opening 234, the arbor member 206 can translate between the first end 230 and the second end 232 of the first slot 222. When the first retention member 306 is positioned at the first end 230 of the first slot 222, the first retention member 306 substantially prevents the arbor member 206 from moving away from the first flange 202 in a longitudinal direction (e.g. withdrawal direction). When the arbor member 206 is positioned within at the second end 232 of the first slot 222, the arbor member 206 and the first flange 202 are free to move away from each other in the longitudinal direction (e.g. withdrawal direction).

In an aspect, the retention member 306 and the first slot 222 of the first flange 202 are configured such that when the retention member 306 is positioned within the first slot 222, the arbor member 206 is substantially prevented from rotating relative to the first flange 202.

Figure 17:
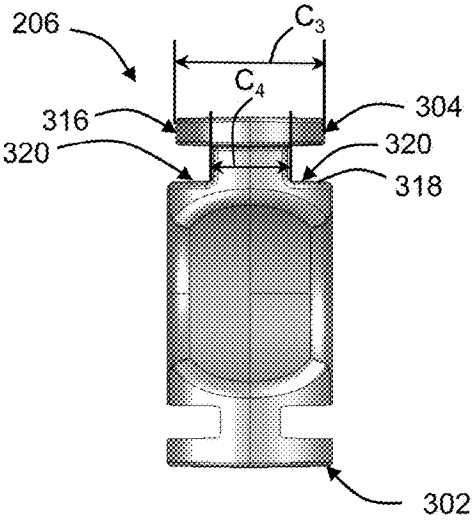
FIG. 17 illustrates a third side view of the arbor member illustrated in FIG. 14.
Figure 16:
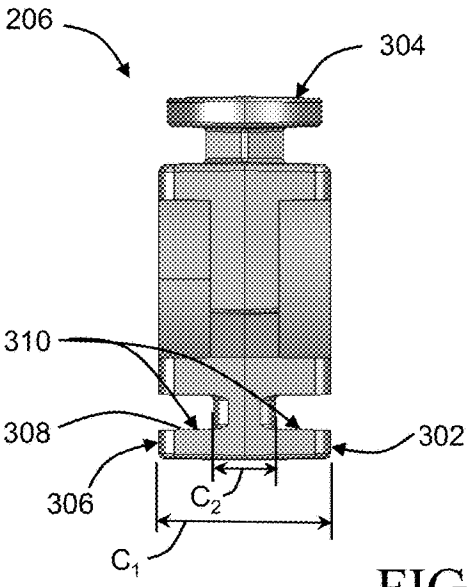
FIG. 16 illustrates a second side view of the arbor member illustrated in FIG. 14.

With reference to FIG. 17, the second end 304 includes the second retention element 316. The second retention element 316 has on outer surface 318 that defines a pair of slots 320. The slots 320 of the second retention element 316 have a third cross-sectional dimension $C_3$ and a fourth cross-sectional dimension $C_4$. The fourth cross-sectional dimension $C_4$ is less than the third cross-sectional dimension $C_3$. The location of the fourth cross-sectional dimension $C_4$ is spaced from the location of the third cross-sectional dimension $C_3$ in a direction toward the first end 302 of the arbor member 206. The third cross-sectional dimension $C_3$ is less than the first width $y_1$ of the first end 276 of the second slot 262 of the second flange 204. The fourth cross-sectional dimension $C_4$ of the second retention member 316 is less than the second width $y_2$ of the second end 278 of the second slot 262 of the second flange 204. The configuration of the arbor member 206 is such that the second end 304 can be inserted into the first end 276 of the second slot 262 of the second flange 204 in a longitudinal direction (e.g. insertion direction). The slots 320 of the second retention member 316 can be positioned within the second opening 274 of the second slot 262 of the second flange 204. When the slots 320 are positioned within the second opening 274, the arbor member 206 can translate between the first end 276 and the second end 278 of the second slot 262. When the second retention member 316 is positioned at the first end 276 of the second slot 262, the arbor member 206 and the first flange 202 are free to move away from each other in the longitudinal direction (e.g. withdrawal direction). When the second retention member 316 is positioned at the second end 278 of the second slot 262, the second retention member 316 substantially prevents the arbor member 206 from moving away from the second flange 204 in a longitudinal direction (e.g. withdrawal direction)

Figure 15:
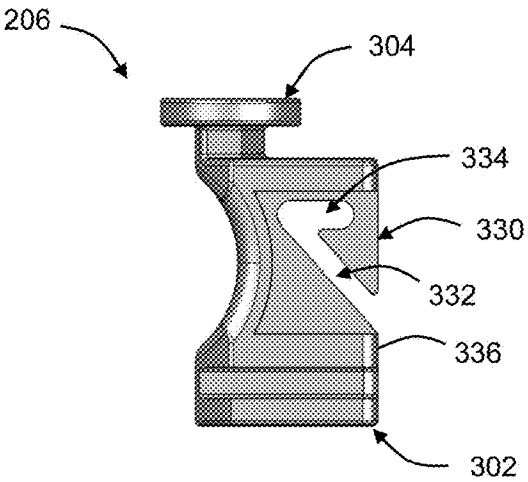
FIG. 15 illustrates a first side view of the arbor member illustrated in FIG. 14.
Figure 14:
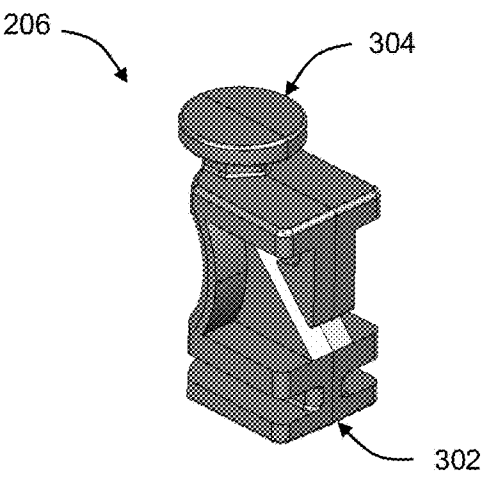
FIG. 14 illustrates a top perspective view of an arbor member of the spool shown in FIG. 5, according to an aspect of this disclosure.

With reference to FIG. 15, the arbor member 206 can include a biasing member retention element 330. The biasing member retention element 330 is configured to receive the biasing member 108 thereon. The biasing member 108 can be inserted through a retention channel 332 and positioned within a retention recess 334. Both of the retention channel 332 and the retention recess 334 can be defined by a surface 336 of the arbor member 206. The retention recess 334 can removably retain the biasing member 108 within.

It will be appreciated that the number of arbor members 206 included in the spool assembly 200 can include the same number as there are slots on the first and second flanges 202 and 204. For example, if the first flange 202 has two first slots 222 and the second flange 204 has two second slots 262, the spool assembly 200 can include two arbor members 206. One arbor member 206 inserted into a first slot 222 in the first flange 202 and a corresponding second slot 262 in the second flange 204. The other arbor member 206 being inserted into the other first slot 222 in the first flange 202 and the other corresponding second slot 262 in the second flange 204. In an aspect, the spool assembly 200 includes the first flange 202 having four first slots 222 and the second flange 204 having four second slots 262. The spool assembly 200 can include four arbor members 206 positioned within each of the slots of the first and second flanges 202 and 204 as described above.

Figure 19:
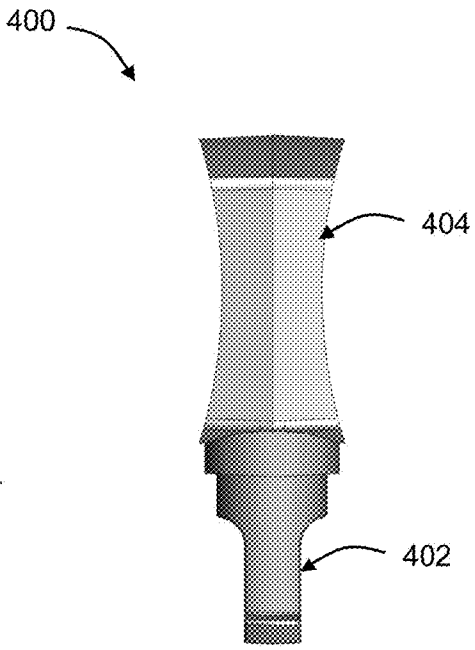
FIG. 19 illustrates a first side view of the handle illustrated in FIG. 18.
Figure 20:
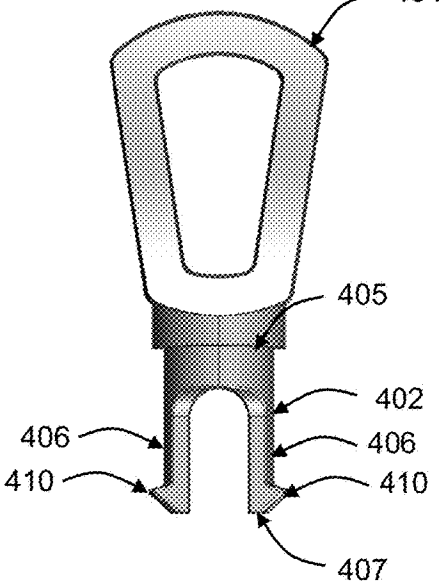
FIG. 20 illustrates a second side view of the handle illustrated in FIG. 18.
Figure 18:
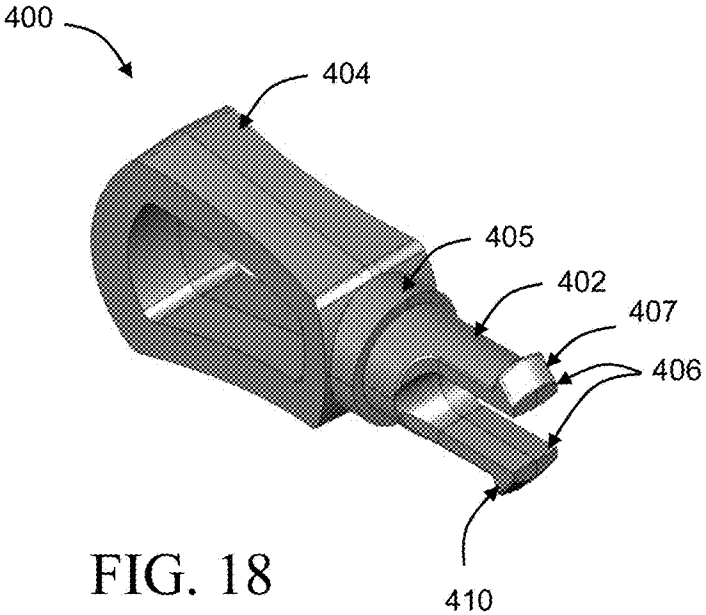
FIG. 18 illustrates a top perspective view of a handle, according to an aspect of this disclosure.

With reference to FIGS. 18-20, the handle 400 includes an insertion end 402 and a gripping end 404. The insertion end 402 includes a pair of legs 406 that extend from a first end 405 of the insertion end 402 to a second end 407 of the insertion end 402 in a direction from the gripping end 404 toward the insertion end 402. Each leg of the pair of legs 406 can include a handle retention element 410. The handle retention element 410 can include, for example, a protrusion that extends radially outward from an outer surface 412 of the leg 406. In an aspect, the handle retention element 410 can provide a snap-fit type connection with the receiving apertures 240, 242, and 280 of the respective first and second flanges 202 and 204 when the handle 400 is inserted into the respective aperture. Each leg of the pair of legs 406 can radially flex to facilitate insertion into the apertures 240, 242, and 280 of the first and second flanges 202 and 204. After insertion into the respective aperture 240, 242, and 280, the handle retention elements 410 can removably secure the handle 400 to the respective flange 202 and 204. It will be appreciated that the handle 400 could include fewer or more legs 406. For example, the handle can include three, four, five, or more legs 406. In an aspect, the legs 406 are spaced circumferentially about the insertion end 402 equidistant from each of the other legs 406.

The spool assembly 200 can include more than one handle 400. For example, a first handle 400 can be coupled to the first receiving aperture 240 of the first flange 202, and a second handle 400 can be coupled to the third receiving aperture 280 of the second flange 204. The legs 406 of the handle 400 can be configured such that when the first and second handles 400 are positioned within the first and third receiving apertures 240 and 280, respectively, the legs 406 of one handle 400 circumferentially intersect the legs 406 of the other handle 400. For example, when the handles 400 are inserted within the respective first and third receiving apertures 240 and 280, the insertion ends 402 of each handle 400 intersect one another along the longitudinal axis. Each leg 406 of each handle 400 is positioned circumferentially between corresponding legs 406 of the other handle 400. This handle configuration can allow the handles 400 to be inserted into the first and second flanges 202 and 204 along the longitudinal axis L.

The first and second flanges 202 and 204, the arbor members 206, the biasing member 108, and the handle 400 can each be separate independent components that are assembled together to form the spool assembly 200. A first arbor member 206 can be inserted into the first slot 222 of the first flange 202. The first arbor member 206 can be inserted into the first slot 222 through the second end 238 until the slots 310 of the first arbor member are positioned within the first opening 234 of the first slot 222. The first arbor member 206 can be slid along the first slot 222 to the first end 236. When the first arbor member 206 is positioned at the first end 236, the first retention member 306 of the first arbor member 206 retains the first arbor member 206 within the first slot 222 such that movement between the first arbor member 206 and the first flange 202 is substantially prevented in the longitudinal direction.

A second arbor member 206 can be inserted into another first slot 222 of the first flange 202. The second arbor member 206 can be inserted into the other first slot 222 through the second end 238 until the slots 310 of the second arbor member are positioned within the first opening 234 of the first slot 222. The second arbor member 206 can be slid along the first slot 222 to the first end 236 to retain the second arbor member 206 within the other first slot 222. This process can be repeated for each first slot 222 defined by the first flange 202.

After the arbor members 206 are positioned within respective first slots 222 of the first flange 202, the biasing member 108 can be coupled to each of the arbor members 206. For example, the biasing member 108 can be inserted through the retention channel 332 and positioned within the retention recess 334 of each of the arbor members 206 that are coupled to the first flange 202. The biasing member 108 biases each of the arbor members 206 toward the first end 236 of each respective first slot 222.

After the biasing member 108 is coupled to each arbor member 206, the arbor members 206 can be inserted into respective second slots 262 of the second flange 204. The arbor members 206 can be inserted into the respective second slots 262 through the first ends 276 until the slots 320 of the arbor members 206 are positioned within the respective second openings 274 of the second slots 262.

After the arbor members 206 are positioned within respective first slots 222 of the first flange 202 and within respective second slots 262 of the second flange, the first flange 202 can be rotated relative to the second flange 204 about the longitudinal axis L. For example, a center of rotation of the first flange 202 relative to the second flange 204 can lie on the longitudinal axis L. When the arbor members 206 are positioned at the respective first ends 236 and 276 of the first and second slots 222 and 262, the arbor members 206 define a minimum arbor diameter. As the first flange 202 rotates relative to the second flange 204, the arbor members translate (e.g. slide) within the respective first and second slots 222 and 262 toward the second ends 238 and 278. As the arbor members 206 translate toward the second ends 238 and 278, the arbor diameter increases in size. When the arbor members 206 reach the second ends 238 and 278 of the respective slots 222 and 262, a maximum arbor diameter can be achieved. It will be appreciated that when the maximum arbor diameter is achieved, the arbor members 206 may be at a location toward the second ends 238 and 278 of the respective slots 222 and 262, as opposed to a location fully at the respective second ends 238 and 278.

The detents 267 defined by the first edge 266 of the second slot 262 can removably retain the arbor members 206 at a position along the respective slot 262. For example, when the first flange 202 is rotated relative to the second flange 204 such that the arbor members 206 are positioned at a location between the first and second ends 276 and 278 of the second slot 262, the arbor member 206 can contact at least one of the plurality of detents 267 to removably retain the arbor member 206 at the location between the first and second ends 276 and 278. A force provided by the biasing member 108 can seat the arbor members 108 within the detents 267. To remove the arbor members 206 from the respective detents 267, an additional rotational force can be applied (e.g. by a user) to the first and second flanges 202 and 204 to unseat the arbor members 206 from the detents 267.

To disassemble the spool assembly 200, the first flange 202 is rotated relative to the second flange 204 until the arbor members 206 are positioned at the respective first ends 276 of the second flange 204. The second flange 204 can then be removed from the arbor members 206 by moving the second flange 204 in a longitudinal direction (e.g. withdrawal direction). After the second flange 204 is removed, each of the arbor members 206 can be slid within the second ends 238 of the respective first slots 222. The arbor members 206 can each be removed from the first flange 202 by moving the arbor members 206 in the longitudinal direction (e.g. withdrawal direction). The biasing member 108 can also be removed from each arbor member 206.

During use of the spool assembly 200, the arbor members 206 are transitioned toward the second ends 238 and 278 of the respective first and second slots 222 and 262 to achieve an increased and/or maximum arbor diameter. A first handle 400 can be inserted into the second receiving aperture 242 of the first flange 202. A second handle 400 can be inserted into the third receiving aperture 280 of the second flange 204. A user can then rotate the spool assembly 200 about the longitudinal axis L by rotating the first handle 400 about the longitudinal axis L. The rotation of the spool assembly 200 can wind the roll of material (e.g. filament) about the arbor members 206. After the roll of material is wound about the arbor members 206, the first flange 202 can be rotated relative to the second flange 204 to slide the arbor members 206 toward the respective first ends 236 and 276 to reduce the arbor diameter. After the arbor diameter is reduced, the second flange 204 can be removed from the arbor members 206, and the roll of material can be removed from the spool assembly 200.

To unwind the roll of material onto a reel, the roll of material can be place about the arbor members 206 coupled to the first flange 202. The second flange 204 can be coupled to the arbor members 206 as described above. The first flange 202 can be rotated relative to the second flange 204 to slide the arbor members 206 toward the respective second ends 238 and 278 to increase the arbor diameter. As the arbor diameter is increased, a tension can be applied to the roll of material by the arbor members 206. A first handle 400 can be positioned within the first receiving aperture 240 of the first flange and a second handle 400 can be positioned within the third receiving aperture 280 of the second flange 204. The roll of material can be removed from the spool assembly 200 by pulling a strand of the material away from the spool assembly 200 causing the first and second flanges 202 and 204 to rotate and unwind the material. The first and second flanges 202 and 204 can rotate relative to the first and second handles 400 to allow the user to grip the handles while the roll of material is unwinding.

Other components can be used to facilitate the process of winding and unwinding the roll of material. For example, twist ties can be incorporated to tie the roll of material after winding, grasping components can be used to hold or grip the handles 400 during winding and unwinding, or still other components can be used.

It will be appreciated that the foregoing description provides examples of the disclosed system and method. However, it is contemplated that other implementations of the disclosure may differ in detail from the foregoing examples. For example, any of the embodiments disclosed herein can incorporate features disclosed with respect to any of the other embodiments disclosed herein. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

As one of ordinary skill in the art will readily appreciate from that processes, machines, manufacture, composition of matter, means, methods, or steps, presently existing or later to be developed that perform substantially the same function or achieve substantially the same result as the corresponding embodiments described herein may be utilized according to the present disclosure.

What is claimed is:

1. A spool assembly for supporting a roll of material, the spool assembly comprising:

a first flange defining a first at least one slot, the first at least one slot extending at least partially in a radial direction, the radial direction extending outward from a longitudinal axis of the spool assembly;

a second flange defining a second at least one slot, the second at least one slot extending at least partially in a transverse direction, the transverse direction being substantially perpendicular to the radial direction and the longitudinal axis, the second flange being rotatably coupled to the first flange such that the first and second flanges rotate relative to one another about the longitudinal axis;

a first arbor member slidably coupled within the first at least one slot of the first flange and slidably coupled within the second at least one slot of the second flange, the first arbor member is positioned at least partially between the first flange and the second flange;

a second arbor member positioned between the first flange and the second flange, wherein a spacing between the first arbor member and the second arbor member in the radial direction defines an arbor diameter; and a biasing member coupled to the first arbor member such that the first arbor member is biased radially inward toward the longitudinal axis, wherein rotation of the first flange relative to the second flange causes the first arbor member to translate within the first at least one slot and the second at least one slot causing a change in the arbor diameter.

2. The spool assembly of claim 1, wherein the first at least one slot includes a first edge spaced apart from a second edge defining a first opening therebetween, the first opening extending from a first end of the first at least one slot to a second end of the first at least one slot spaced radially outward from the first end, wherein a width of the first opening at the second end is greater than a width of the first opening at the first end, and wherein the first opening at the second end is located closer to a perimeter of the first flange than the first opening at the first end.

3. The spool assembly of claim 2, wherein the first at least one arbor member includes a first retention element, the first retention element having a first cross-sectional dimension, the first cross-sectional dimension being greater than the width of the first opening at the first end and less than the width of the first opening at the second end such that when the first at least one arbor is positioned within the first at least one slot at the first end, the first retention element substantially prevents the first at least one arbor and the first flange from moving away from each other in a longitudinal direction, and wherein when the first at least one arbor is positioned within the first at least one slot at the second end, the first at least one arbor and the first flange are free to move away from each other in the longitudinal direction.

4. The spool assembly of claim 2, wherein the first at least one slot extends substantially linearly in the radial direction from the first end to the second end.

5. The spool assembly of claim 1, wherein the second at least one slot includes a first edge spaced apart from a second edge defining a second opening therebetween, the second opening extending from a first end of the second at least one slot to a second end of the second at least one slot spaced radially outward from the first end, wherein a width of the second opening at the second end is less than a width of the second opening at the first end.

6. The spool assembly of claim 5, wherein the first at least one arbor member includes a second retention element, the second retention element having a second retention diameter, the second retention diameter being greater than the width of the second opening at the second end and less than the width of the second opening at the first end such that when the first at least one arbor is positioned within the second at least one slot at the second end, the first retention element substantially prevents the first at least one arbor and the second flange from moving away from each other in a longitudinal direction, and wherein when the first at least one arbor is positioned within the first at least one slot at the first end, the first at least one arbor and the second flange are free to move away from each other in the longitudinal direction.

7. The spool assembly of claim 5, wherein the second at least one slot extends in an arcuate shape from the first end to the second end.

8. The spool assembly of claim 5, wherein the first edge of the second at least one slot is spaced radially inward from the second edge of the second at least one slot along a length of the second at least one slot from the first end to the second end, the first edge defining a plurality of detents thereon.

9. The spool assembly of claim 1, wherein the first at least one slot extends through the first flange from a first inner flange surface to a first outer flange surface.

10. The spool assembly of claim 1, wherein the first at least one slot comprises a plurality of first slots, and the second at least one slot comprises a plurality of second slots, the first arbor member being slidably coupled within a first slot of the plurality of first slots of the first flange and slidably coupled within a first slot of the plurality of second slots of the second flange, wherein the second arbor member is slidably coupled within a second slot of the plurality of first slots of the first flange and slidably coupled within a second slot of the plurality of second slots of the second flange, wherein rotation of the first flange relative to the second flange causes the second arbor member to translate within the second slot of the first plurality of slots and the second slot of the plurality of second slots causing a change in the arbor diameter.

11. The spool assembly of claim 10, wherein the biasing member is coupled to the second arbor member such that the second arbor member is biased radially inward toward the longitudinal axis.

12. The spool assembly of claim 10, wherein the plurality of first slots comprises four slots, and wherein the plurality of second slots comprises four slots.

13. The spool assembly of claim 1, wherein the first flange defines a first receiving aperture and the second flange defines a second receiving aperture, wherein one of the first and second receiving apertures extends about a center of rotation of the first flange relative to the second flange, and the other of the first and second receiving apertures is spaced radially outward from the center of rotation, the spool assembly further comprising:

a first handle insertable into the first receiving aperture; and a second handle insertable into the second receiving aperture.

14. The spool assembly of claim 13, wherein the first receiving aperture is spaced radially outward from the center of rotation of the first flange relative to the second flange, and wherein the second receiving aperture extends about the center of rotation of the first flange relative to the second flange, wherein the first flange further defines a third receiving aperture, the third receiving aperture extending about the center of rotation of the first flange relative to the second flange, wherein the first handle is further insertable into the third receiving aperture.

15. The spool assembly according to claim 1, wherein the first arbor member includes a first face that is oriented towards a center of rotation of the first flange and a second face that is oriented towards a perimeter of the first flange, and wherein the biasing member is coupled to the first arbor member at the first face thereof.

16. A method of assembling a spool assembly, the spool assembly including a first flange, a second flange, and a first arbor member, the first flange defining a first at least one slot, the first at least one slot extending at least partially in a radial direction, the radial direction extending radially outward from a longitudinal axis of the spool assembly, the first arbor member slidably coupled within the first at least one slot, the method comprising:

inserting the first arbor member into the first at least one slot defined by the first flange; and coupling a biasing member to the first arbor member such that the first arbor member is biased radially inward toward the longitudinal axis, wherein rotation of the first flange relative to the second flange causes the first arbor member to translate within the first at least one slot causing a change in an arbor diameter.

17. The method of claim 16, further comprising:

inserting the first arbor member into a second at least one slot defined by the second flange, the second at least one slot extending at least partially in a transverse direction, the transverse direction being substantially perpendicular to the radial direction and the longitudinal axis.

18. The method of claim 17, wherein the first at least one slot includes a plurality of first slots, and wherein the second at least one slot includes a plurality of second slots, the first arbor member being inserted into a first slot of the plurality of first slots of the first flange and into a first slot of the plurality of second slots of the second flange, the method further comprising:

inserting a second arbor member into a second slot of the plurality of first slots of the first flange; and inserting the second arbor member into a second slot of the plurality of second slots of the second flange, wherein rotation of the first flange relative to the second flange causes both of the first arbor member and the second arbor member to translate within their respective slots.

19. The method of claim 16, wherein the step of coupling the second flange to the first arbor member comprises:

rotating the second flange relative to the first flange from a first position to a second position, wherein in the first position, the second flange is free to move away from the first arbor member in a longitudinal direction, and wherein in the second position, the second flange is substantially prevented from moving away from the first arbor member in the longitudinal direction.

20. The method of claim 16, wherein the first flange defines a first receiving aperture and the second flange defines a second receiving aperture, wherein one of the first and second receiving apertures extends about a center of rotation of the first flange relative to the second flange, and the other of the first and second receiving apertures is spaced radially outward from the center of rotation, the method further comprising:

inserting a first handle into the first receiving aperture; and inserting a second handle into the second receiving aperture.

21. The method according to claim 16, wherein the biasing member is coupled to the first arbor member at a face of the first arbor member that is oriented towards a center of rotation of the first flange in order to bias the first arbor radially inward toward the longitudinal axis.

* * * * *